US006997458B1

(12) United States Patent
Yokomi

(10) Patent No.: US 6,997,458 B1
(45) Date of Patent: Feb. 14, 2006

(54) PLURAL SIDED ROLLING GAME PIECE AND METHOD OF PLAY

(76) Inventor: Darrick Yokomi, 18694 Santa Carmela St., Fountain Valley, CA (US) 92708

( * ) Notice: Subject to any disclaimer, the term of this patent is extended or adjusted under 35 U.S.C. 154(b) by 15 days.

(21) Appl. No.: 10/969,605

(22) Filed: Oct. 20, 2004

(51) Int. Cl.
*A63F 3/00* (2006.01)

(52) U.S. Cl. ..... 273/288; 273/146

(58) Field of Classification Search ..... 273/146, 273/288, 246; D21/369, 371, 372
See application file for complete search history.

(56) References Cited

U.S. PATENT DOCUMENTS

| | | | | |
|---|---|---|---|---|
| 1,398,852 | A | | 11/1921 | Gilbert |
| 1,880,130 | A | | 9/1932 | Goldbach |
| 2,284,458 | A | | 5/1942 | Van Antwero |
| 3,120,278 | A | | 2/1964 | Bessinger |
| 3,144,265 | A | * | 8/1964 | Humble ..... 403/219 |
| 3,417,505 | A | | 12/1968 | Schultz |
| 3,813,841 | A | * | 6/1974 | Tsurumi ..... 52/648.1 |
| 4,124,881 | A | * | 11/1978 | Haber et al. ..... 362/253 |
| 4,416,453 | A | | 11/1983 | Sasso |
| 4,674,750 | A | | 6/1987 | Abu-Shumays et al. |
| 4,836,787 | A | | 6/1989 | Boo |
| 5,145,175 | A | | 9/1992 | Gathman et al. |
| 5,425,537 | A | | 6/1995 | Vogelsang |
| 6,015,149 | A | | 1/2000 | Burk |
| 6,076,318 | A | | 6/2000 | Grimm et al. |

FOREIGN PATENT DOCUMENTS

| | | |
|---|---|---|
| EP | 1428560 | 6/2004 |

* cited by examiner

*Primary Examiner*—Vishu K. Mendiratta
(74) *Attorney, Agent, or Firm*—Gene Scott and Patent Law & Venture Group

(57) ABSTRACT

A game piece has a continuous wall closed on itself so as to define a hollow space within. The wall is made-up of a plurality of flat plates, where each of the plates is shaped as a polygon with straight side edges. Corresponding pairs of the side edges of adjacent pairs of the plates are aligned in parallel, and each pair of the adjacent side edges of the adjacent plates is joined by a rigid compression clip having opposing C-clamps.

8 Claims, 2 Drawing Sheets

PLURAL SIDED ROLLING GAME PIECE AND METHOD OF PLAY

BACKGROUND OF THE INVENTION

1. Related Applications none

2. Field of the Invention

This invention relates generally to interlocking game pieces, dice games, puzzles, ball games and the like.

3. Description of Related Art

The following art defines the present state of this field and each disclosure is hereby incorporated herein by reference:

Gilbert, U.S. Pat. No. 1,398,852, describes the construction of toy buildings, with combinations of panels which when placed edge to edge and assembled form the building, said panels being provided with a pair of rectangular recesses at either side of each corner, some of the panels having recesses intermediate the corners, and means consisting of a plurality of U-shaped clamps joined together at their closed ends, for connecting the edges of the panels together at the corners and at intermediate points, the rectangular recesses of adjacent panels cooperating to form a seat for the intermediate portion of the connecting means.

Goldbach, U.S. Pat. No. 1,880,130, describes a puzzle of the knock-down type composed of a plurality of parts, certain of said parts being provided with slots only; certain of said parts being provided with tongues only; certain of said parts being provided with slots and tongues; certain of said parts being provided with slots and a single tongue; certain of said parts being provided with tongues and a single slot and said slots being adapted to receive said tongues to provide an interlocking of said parts to form pre-determined designs.

Bessinger, U.S. Pat. No. 3,120,078, describes a toy construction kit comprising a plurality of substantially flat panel members having various peripheral shapes, each panel being provided with a plurality of apertures therethrough adjacent the peripheral edges thereof, a separate peg extending into each of said apertures, said pegs being co-planer and integral with their respective associated panel members, and a plurality of continuous elastic bands each adapted to be removeably attached to one of said pegs on one of said panel members and extended to be removably attached to a corresponding peg on an adjacent panel member to hold adjacent panels contiguous to each other to form a three dimensional structure in their assembled state.

Schultz, U.S. Pat. No. 3,417,505, describes a toy structural space panel formed with an outer portion lying in a plane, a reinforcing groove formed about the outer portion, said reinforcing groove defining the periphery of an inner portion, said inner portion comprising planar sections, at least two of which lie in intersecting planes perpendicular to that of the outer portion, said two perpendicular sections having opposite edges defining the width thereof and an end terminating at said groove, said perpendicular sections being joins at said edges to said reinforcing grooves.

Konami Corporation, E.P. 1428560, describes a board game played by plural players comprising; a play field having a plurality of polygonal grids extending continuously and used by the plural players, and plural game component sets used by the plural players for their own play, the game component sets comprising: plural dice, plural kinds of pieces respectively having visually identifiable features and belonging to predetermined plural groups and/or predetermined levels, and plural cards corresponding to the plural kinds of pieces and describing at least denominations to identify corresponding pieces, capacity or ability of the corresponding pieces, conditions for wielding or exerting the capacity or ability of the pieces, and the groups and/or the levels; the dice being polyhedrons consisting of n (n is an integer of three or more) polygonal plates which have substantially the same dimensions with the polygonal grids of the play field and are connected in such a manner that unfolding of the dice is possible.

Sasso, U.S. Pat. No. 4,416,453, describes a puzzle in the form of a multi-colored regular solid. Plates corresponding to the adjacent faces of the regular solid are disposed on said faces and divided into a plurality of triangles of different colors, and which triangles have adjacent edges. The plates are coupled in pairs and the pairs are rotatable relative to their respective faces. The object of the puzzle is to rotate the pairs of plates so that none of the adjacent edges of the triangles are of the same color.

Abu-Shumays et al, U.S. Pat. No. 4,674,750, describes two distinct dodecahedron cubic puzzles, one a Rhombic Dodecahedron Puzzle having twelve diamond faces and the other a Regular Dodecahedron Puzzle having twelve pentagon faces. The ideas involved can be readily applied to other puzzles having newer shapes such as the rhombic triacontahedron. The distinguishing features of these puzzles are briefly described. Each of the puzzles is comprised of component pieces which are joined and held together by an appropriate means. The external surfaces of each puzzle are to be assigned a unique combination of colors or pictures or monthly calendars. The mechanism of motion makes it possible to rotate the individual component pieces of a puzzle in groups around lines joining the puzzle center and the puzzle vertices. Various possible rotations (twists and turns) result in mixing up the surface configurations. The object and the challenge is to restore the various surfaces of a puzzle into their original form, or to perform twists and turns that would result in alternate interesting designs.

Boo, U.S. Pat. No. 4,836,787, describes sheet material building components or units in the shape of different regular polygons of equal edge length have strips of hook-and-pile fastening materials permanently secured so as to extend along their side edges. Hook type fastening material is disposed toward one end portion of each side edge and pile type fastening material is disposed toward the other end portion of each side edge. The strips of hook type and pile type fastening materials alternate around the circumference of each unit. Different units can be connected substantially edge-to-edge by simply placing the desired edges in contact to form a wide variety of two-dimensional or three-dimensional arrays or shapes.

Gathman et al, U.S. Pat. No. 5,145,175, describes 12-sided and 20-sided dice which have a suit symbol and a value symbol on each surface representing one of the various playing cards in a standard 52 card playing deck. The 12-sided die will carry 3 different value symbols for each of the 4 suits and, accordingly, will depict 12 different cards, one on each of its surfaces which are identically shaped pentagons. A game is disclosed which employ three or more of such dice, all identical. In another embodiment a 20-sided die is provided which carries 5 values of each of the four suits. In all embodiments, parallel, opposing surfaces will bear the same value symbol and no two surfaces adjoined together along a common edge will bear the same suit symbol. This symmetrical arrangement provides for integrity of change in re- rolling the dice and complete randomness of chance.

Vogelsang, U.S. Pat. No. 5,425,537, describes a game played by rolling a plurality of multi-faced dice and accumulating a total of the numbers shown on the up faces of the dice. One face of each die bears a symbol, and the player loses the points accumulated during his turn if one of the dice displays a symbol as a result of having been rolled, and the player loses all of his points if both of the dice displays the symbols as a result of the roll.

Burk, U.S. Pat. No. 6,015,149, describes a card game in which cards can be readily assembled and disassembled from a wide variety of three dimensional structures. The game includes card holders which enable cards to be assembled into a structure with cards extending along several axes normal to one another and with a plurality of cards extending vertically upward from a support surface.

Grimm et al, U.S. Pat. No. 6,076,318, describes an arcuate structure containing at least sixty six-sided building blocks, where the six-sided building blocks are independently able to provide means for connecting joining them. The outside face of the six-sided block has a substantially rhomboidal shape, and is substantially parallel to the inside face of the six- sided block. The right edges and the left edges have equal lengths and form equal angles with the inside face and outside face. The left and right sides of the six-sided block are congruent with each other, are in the shape of a parallelogram, and contain two recesses and two projections within their borders. The six-sided block contains a top side with a substantially rectangular shape and a recess and disposed within such shape, a left and right side, each of which are congruent with the left and right sides of the six-sided block, and a front and back side, each of which are congruent with each other and with the back side of the six-sided block.

Our prior art search with abstracts described above teaches: symmetrical dice with card indicia; interlocking puzzles; card stacking games; a method for playing a dice game; a constructional kit educational aid and toy; the dodecahedron class of cubic puzzles; a regular solid multicolored puzzle; a building toy; a puzzle; an educational building setup for rough plumbing; a construction toy comprising panels of sheet connectable by elastic bands; space panels; and a board game with method of play. Thus, the prior art shows, the utilitarian use of a closed plural sided object made up of individual plates (Bessinger, Goldbach, Sasso) and the joining of such plates using opposing C-clamps (Schultz, Van Antwerp, Gilbert, Burk). The prior art also teaches the dodecahedron class of puzzles (Abu-Shumays et al, Vogelsang), in the field of games as well as the use of interlocking piece construction games. However, the prior art fails to teach a hollow ball made up of interlocking resilient plates joined by their edges using C-shaped clamps having dual opposing legs in one embodiment, and three equally spaced legs in an alternate embodiment. The present invention fulfills these needs and provides further related advantages as described in the following summary.

SUMMARY OF THE INVENTION

The present invention teaches certain benefits in construction and use which give rise to the objectives described below.

In the best mode of the present invention, a game piece has a continuous wall closed on itself so as to define a hollow space. The wall is made-up of a plurality of flat plates, where each of the plates is shaped as a polygon with straight side edges. Corresponding pairs of the side edges of adjacent pairs of the plates are aligned in parallel, and each pair of the adjacent side edges of the adjacent plates is joined by a rigid compression clip having opposing C-clamps.

A primary objective of the present invention is to provide an apparatus and method of use of such apparatus that yields advantages not taught by the prior art.

Another objective of the invention is to provide a construction project for those interested in assembling an object from a plurality of separate parts.

A further objective of the invention is to provide a game ball whose outer surface is comprised of individual plates presenting various indicia, so that games of chance may be played by rolling the ball and determining a result by which indicia is face up when the game ball comes to rest.

A still further objective of the invention is to provide such a game ball whose individual plates may be rearranged or replaced.

A yet further objective of the invention is to provide such a game ball whose primary means of plate retention in the game ball is the resilient forces of the plates against C-clamps used for engage each of the plates with others.

Other features and advantages of the embodiments of the present invention will become apparent from the following more detailed description, taken in conjunction with the accompanying drawings, which illustrate, by way of example, the principles of at least one of the possible embodiments of the invention.

BRIEF DESCRIPTION OF THE DRAWINGS

The accompanying drawings illustrate at least one of the best mode embodiments of the present invention. In such drawings.

DETAILED DESCRIPTION OF THE INVENTION

The above described drawing figures illustrate the present invention in at least one of its preferred, best mode embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

Figure 1:
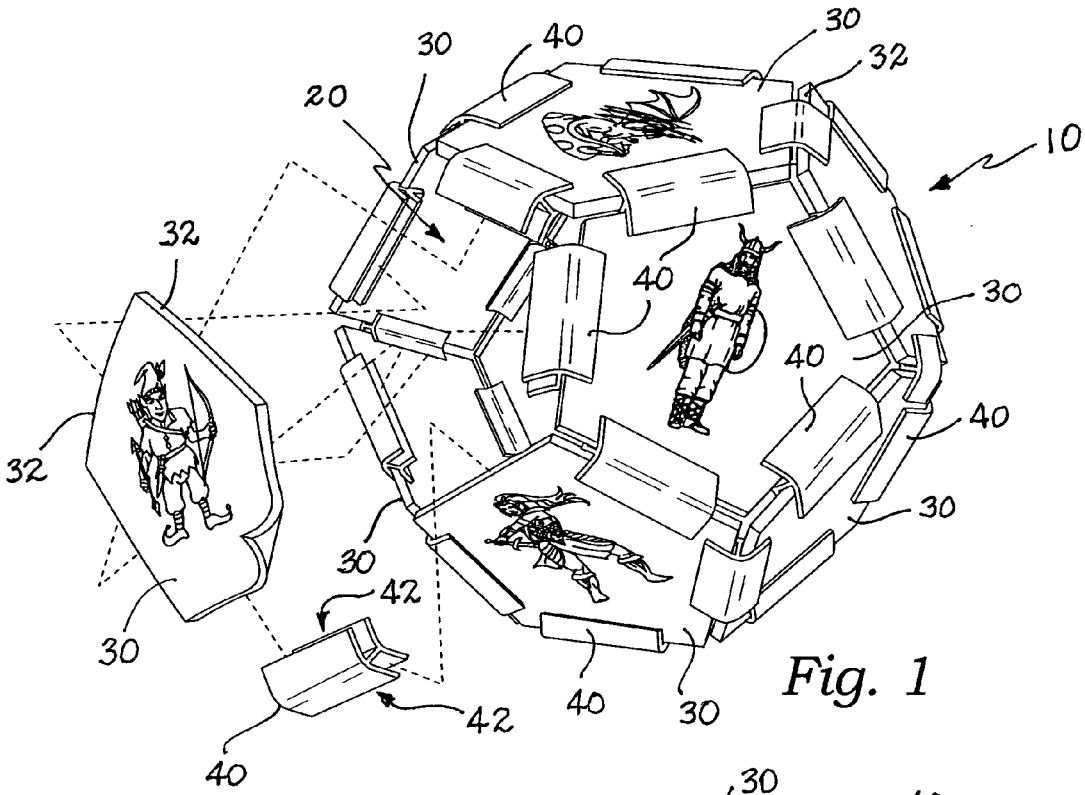
FIG. 1 is a perspective view of one aspect of the invention, showing a plate and a clip of the invention removed to show details of construction, and showing that each clip is engaged with two of the plates.
Figure 2:
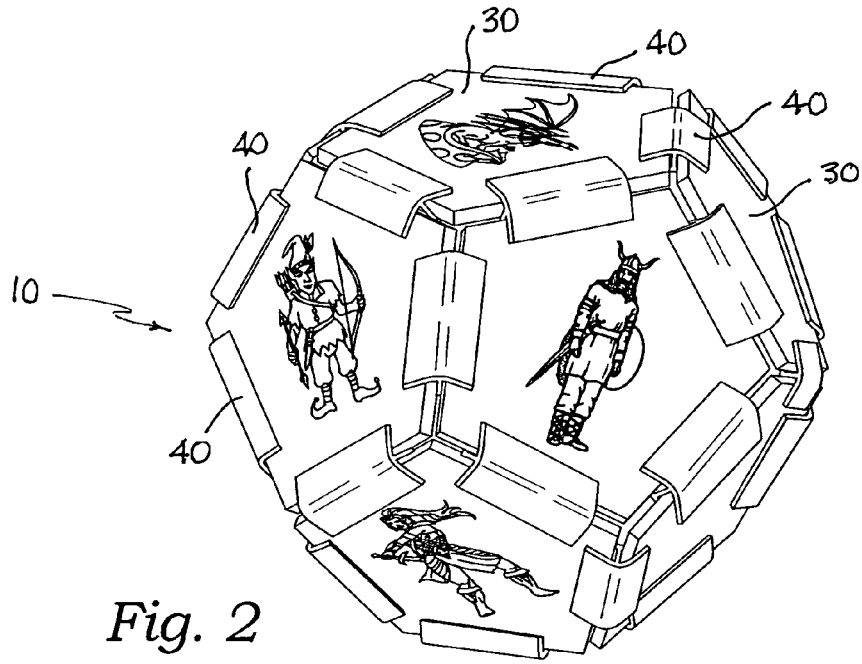
FIG. 2 is the same as FIG. 1 showing the removed plate replaced on the side of the invention.
Figure 3:
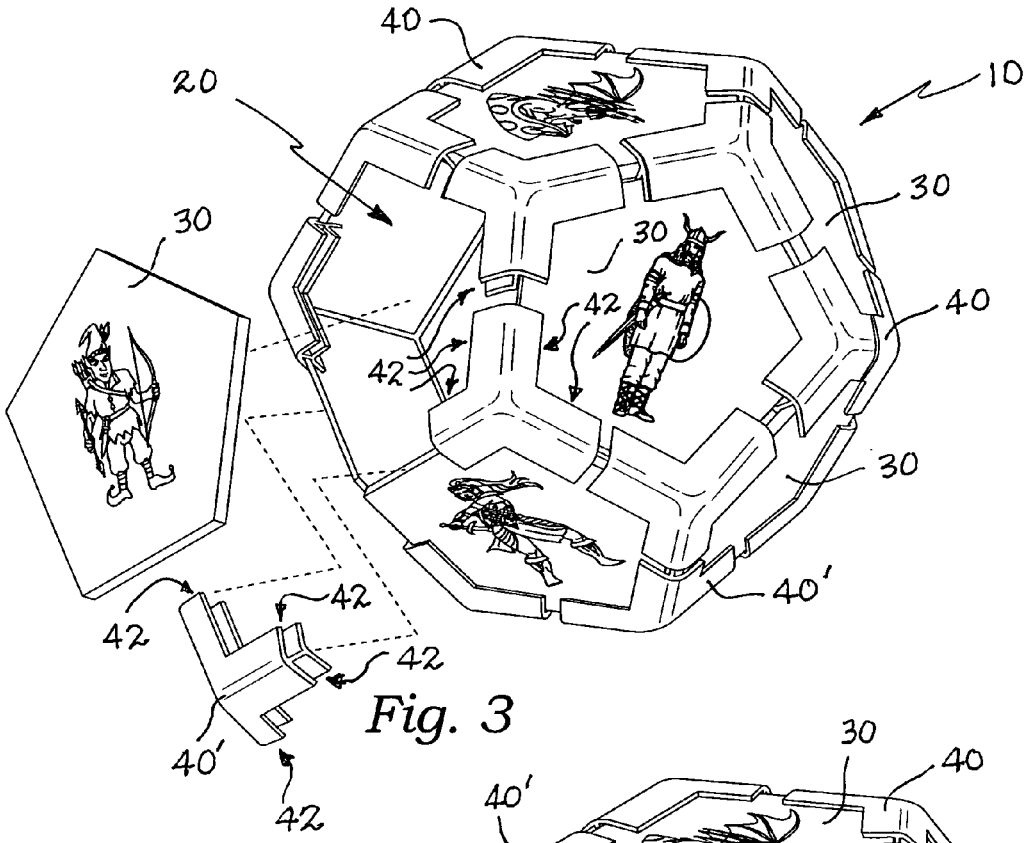
FIGS. 3 and 4 are similar to FIGS. 1 and 2 respectively, showing a variation of the clip and showing that each clip is engaged with three of the plates.

In one embodiment of the present invention a game piece apparatus comprises a continuous wall 10 is closed on itself so as to define a hollow space 20 bounded by the wall 10 as shown in FIGS. 1 and 3. The wall 10 is formed and made up of a plurality of identical flat plates 30. Each of the plates 30 is preferably shaped as a polygon with straight side edges 32. Corresponding pairs of the side edges 32 of adjacent pairs of the plates 30 are aligned in parallel, as shown. Each pair of the adjacent side edges 32 of the adjacent plates 30 are joined by a compression clip 40, shown in FIGS. 1 and 2, or 40' shown in FIGS. 3 and 4, and the clips 40 and 40' provide opposing C-clamps 42. Preferably, the opposing C-clamps 42 are set at an obtuse angle of less than 180 degrees, as clearly shown in FIGS. 1 and 3.

In the embodiment shown in FIGS. 1 and 2, the compression clips 40 each provide dual, opposing C-clamps 42 as shown in FIG. 1. The dual C-clamps 42 are each positioned and engaged with edges 32 of the adjacent plates 30, as shown in FIGS. 1 and 2, wherein the side edges 32 are forced into the C-clamps 42 and held therein by resilient forces within the material that makes up the plates 30. In this embodiment twelve plates are used and connected by 30 clips 40.

Figure 4:
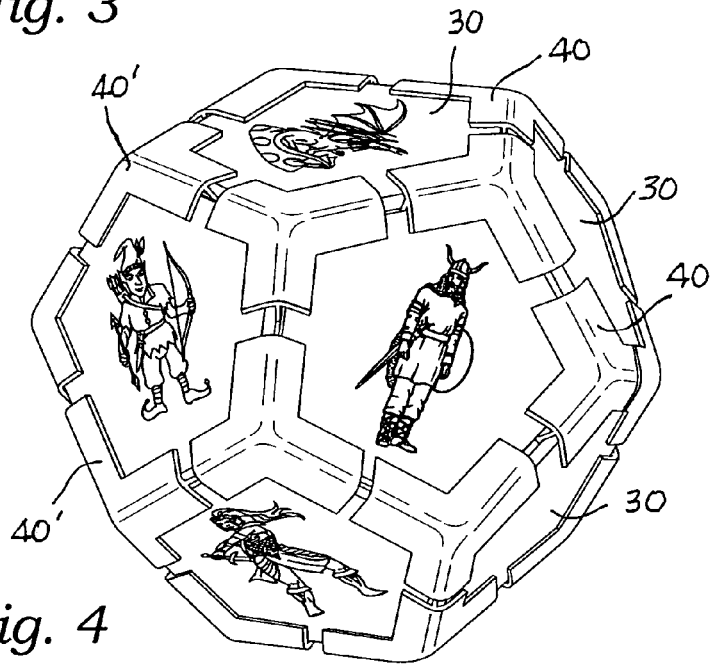

In the embodiment shown in FIGS. 3 and 4, the compression clips 40 provide three, equally spaced apart pairs of C-clamps 42 as shown in FIG. 3. These tri-legged C-clamps 42 are each positioned at the apex of three of the adjacent plates 30 and are engaged with them, as shown in FIGS. 3 and 4, wherein the side edges 32 of the adjacent plates 30 are forced into the C-clamps 42 and held therein by resilient forces within the material that makes up the plates 30. In this embodiment twelve plates are used and connected by only 20 clips. Thus, this embodiment uses fewer parts and also results in a stronger assembly.

In order to assure a strong engagement between the C-clamps 42 and the plates 30, preferably, the plates are deformable, being made of neoprene or similar soft rubber-like material having the necessary resilience. When the edges 32 of the plates 30 are forced into the C-clamps 42, the plates 40 are compressed. Thus, the compression force created by compressing the plates 40 tends to engaged the C-clamps 42 preventing the C-clamps 42 from pulling away from the plates 30. Additionally, the clips 40 are set in the wall with opposing forces from the adjacent plates 30. Thus, the rigidity of the plates tends to prevent the clips from pulling away from the plates 30. The result of this closed construction of the wall 10 is that the apparatus is unusually strong and will take the impact forces normally applied to such closed objects (balls) without rupturing.

In one particularly desirable embodiment of the present invention, the apparatus takes the form of a dodecahedron as shown in the figures, and the plates 30 are five sided (pentagons), as also shown.

Preferably, each of the plates presents an outer surface having an indicia printed on it so that when the apparatus is rolled on a surface such as a ground surface, it naturally comes to rest with one of the plates and its indicia facing upwardly. Many games of chance may be played with the apparatus where bets may be taken on which indicia will face up after the apparatus is rolled. Alternately, such games may be played by establishing rules wherein the indicia that faces upwardly after each roll of the apparatus is indicative of an event, an action, a situation or other aspect of such games.

The enablements described in detail above are considered novel over the prior art of record and are considered critical to the operation of at least one aspect of one best mode embodiment of the instant invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of the embodiments of the herein described invention and its related embodiments not described are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A game piece apparatus comprising: a continuous wall closed on itself so as to define a hollow space within; the wall formed of a plurality of flat, deformable and resilient plates; each of the plates shaped as a polygon with straight side edges; corresponding pairs of the side edges of adjacent pairs of the plates being aligned in parallel; and each pair of the adjacent side edges of the adjacent plates is joined by a compression clip having opposing C-clamps, wherein each of the opposing C-clamps share a common planar wall, the side edges of each of the adjacent pairs of plates within each of the C-clamps abuting the corresponding common wall.

2. The apparatus of claim 1 wherein the opposing C-clamps are set at an obtuse angle of less than 180 degrees.

3. The apparatus of claim 2 wherein the compression clips provide three equally spaced apart legs, each of the legs providing the opposing C-clamps, each of the compression clips positioned at an apex of three of the adjacent ones of the plates.

4. The apparatus of claim 2 wherein the apparatus is formed as a dodecahedron having twelve plates and 30 clips.

5. The apparatus of claim 3 wherein the apparatus is formed as a dodecahedron having twelve plates and 20 clips.

6. The apparatus of claim 1 wherein the polygon is live-sided.

7. The apparatus of claim 1 wherein each of the plates presents an outer surface having an indicia.

8. The apparatus of claim 1 wherein the apparatus is formed in a shape wherein the apparatus naturally comes to rest with one of the plates facing upwardly when the apparatus is rolled on a surface.

* * * * *